US005151840A

United States Patent [19]

Siefken

[11] Patent Number: 5,151,840

[45] Date of Patent: Sep. 29, 1992

[54] SWITCH PROTECTION CIRCUIT

[75] Inventor: Allen J. Siefken, Lake Oswego, Oreg.

[73] Assignee: RAJ Industries, Inc., Lake Oswego, Oreg.

[21] Appl. No.: 580,639

[22] Filed: Sep. 11, 1990

[51] Int. Cl.[5] ..... H01H 9/30

[52] U.S. Cl. ..... 361/13; 361/2; 361/93

[58] Field of Search ..... 361/2, 13, 57, 93, 111, 361/56, 54, 3, 6, 8; 307/137

[56] References Cited

U.S. PATENT DOCUMENTS 3,330,992 11/1964 Perrins ..... 361/13
4,656,554 4/1987 Maschek et al. ..... 361/54

OTHER PUBLICATIONS

Electronic Industries Association, Engineering Department, EIA Standard RS-421-A, dated Mar., 1983, pp. 36-42.
PHD, Inc., Catalog No. 917D, "Proximity Switches for Tom Thumb Cylinders and PHD Actuators", p. 7.
Aleph International Corporation, undated catalog, "Magnetic Reed Switches".
Parker Cylinder Division, Catalog No. 0960, "Stainless Steel Body Air Cylinders", Nov., 1987, p. 31.
Aeroquip Corporation, Bulletin 4100A, "Series TP Proximity Switches", dated Mar. 1987, pp. 4 and 5.
W. Gunther GmbH, Catalog, "Reed Switches", dated Oct. 1986, pp. 22 and 23.
Hasco Components Inc., Catalog, "OKI Reed Switches", printed in Japan in 1987, (1 page).

*Primary Examiner*—A. D. Pellinen
*Assistant Examiner*—C. Schultz
*Attorney, Agent, or Firm*—Buchanan Ingersoll

[57] ABSTRACT

A circuit for the protection the contacts of a switch device such as a reed switch when used in a control circuit. The protection circuit isolates the switch contacts from the load it is controlling by establishing parallel electrical current paths between two inputs. Two such parallel paths provide for a symmetrical bidirectional current flow within the protection circuit. Each parallel path contains a controlled switching device which conducts the current in the respective parallel path when the input polarity is in a given direction. The controlled switching device may be controlled from a polarity sensing in the primary branch which contains the switch device. A single parallel path between inputs can be used to provide polarized DC operation. Diodes in the primary path containing the switch device provide for polarity sensing for control of the controlled switch devices in the parallel paths.

22 Claims, 1 Drawing Sheet

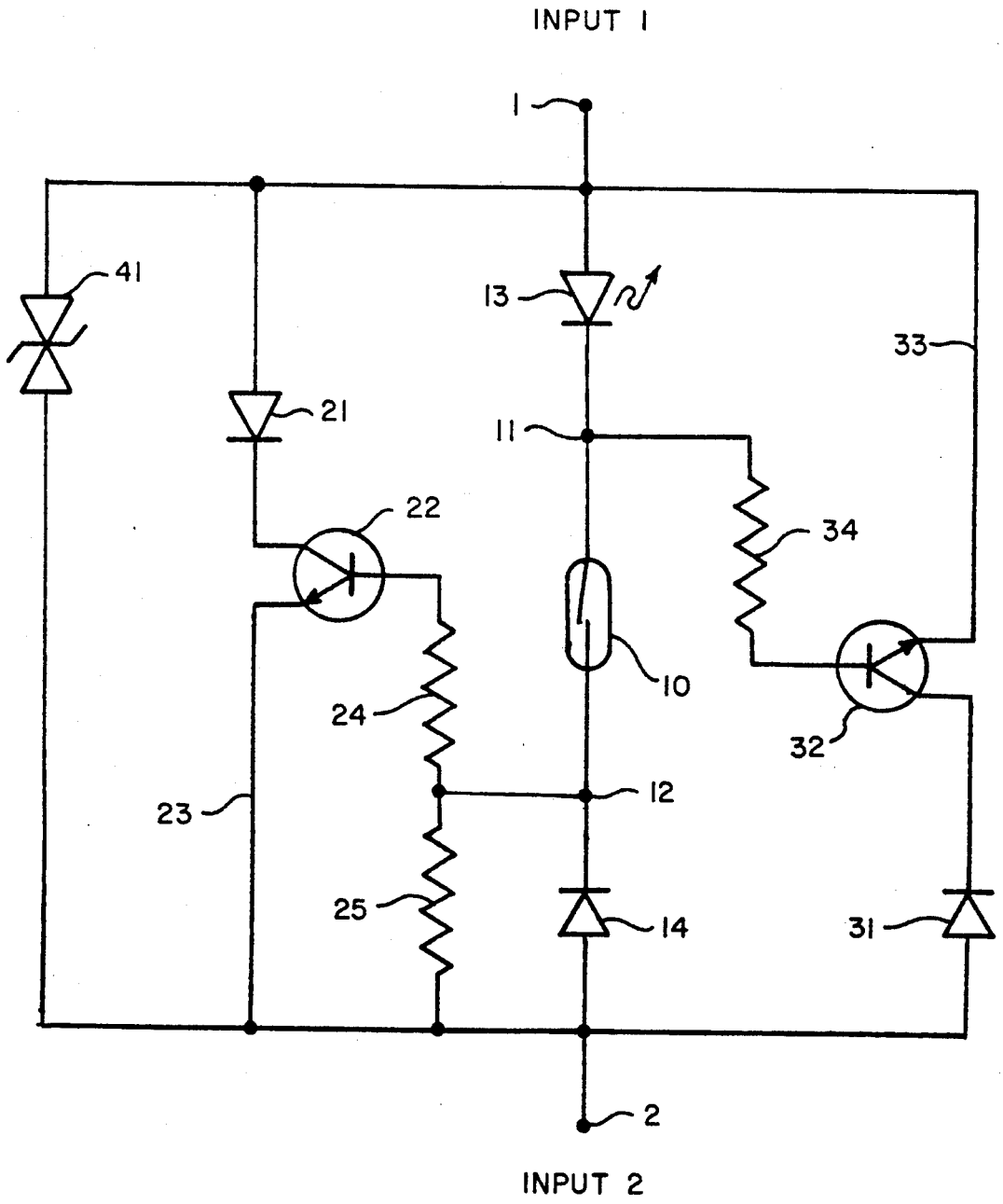
INPUT 1
1
41
13
33
21
11
22
34
10
24
32
23
12
25
14
31
2
INPUT 2

SWITCH PROTECTION CIRCUIT

BACKGROUND OF THE INVENTION

1. Field of the Invention

This invention relates to an electronic circuit for the protection of switches, such as reed switches or other electrical contacts, from electrical transients and surges. Transient electrical conditions occurring during electrical contact opening and closing can have adverse effect on switch life and the circuitry of this invention reduces such adverse effects.

2. Description of Related Art

Electrical transients and surges seriously shorten the operating life of switch devices such as reed switches. These voltage and current surges and transients typically show up when the switch is used to directly control high current, inductive, or capacitive loads. Such loads typically include relays, air valve control solenoids, inductive motors, long cable runs, bypass capacitors, and large wattage incandescent light bulbs. In addition, transient loads can be induced on the power line by lightning storms and the operation of high power or high power electrical machinery.

Switch operation, and in particular reed switch operation, is old and well-known, and manufacturers design equipment with high concern for reliability and with long life as a consideration. Typically, manufacturers suggest a hundred million plus operations as life cycle tests. Such tests, however, are conducted generally with low current loads, such as 10 mA and pure resistive loads in the external circuits. The result is that, while such reed switches can endure this low current and passive loads in cycle tests, when such devices are operated at their rated capacity, such as 1 amp and 200 volt maximum, the expected life of the reed switch is very significantly reduced. Electrical contacts on such switches can deteriorate much more rapidly than their normal life expectancy, resulting in the contacts pitting, degrading, and welding together. Such switch units often fail by having their contacts stick or weld together, or by creating a high resistance electrical contact surface. When such failures occur in industrial applications the equipment is removed from service and inspected. Often when the device is ready for test the natural vibration and mechanical shock of removal from service will break the contact weld and provide a temporary "fix" to the switch contact problem. This results in the equipment being returned to industrial service and providing a machine whose operation is intermittent and unpredictable. When operating in an unprotected mode, such as a fluid cylinder proximity circuit, reed switches can fail after the first 5,000 to 50,000 operations. This is a highly undesirable reduction from the desired life of such switch.

Prior solutions to these problems have included the use of a diode across the inductive load. While this method works well in some applications, it will not work for AC applications. In addition the person installing the diode must be aware of the circuit operation and the polarity of the diode relative to the solenoid and the circuit voltages.

Other solutions have been to use diodes in combination with zener diodes or other semiconductor devices to absorb spikes. In addition, RC networks and magnetic oxide varistors in parallel with the inductive circuit load have also been tried. Use of RC networks require that the resistance and capacitance values be selected according to the characteristics of the inductive load, and therefore must be selected and coordinated for each specific application.

Disadvantages of the above solutions to the problem include the difficulty of containing proper polarity of protection circuits, the limitations of many circuits to only DC operation, and the minimal improvement in life expectancy of switch operation provided by any of the circuits.

SUMMARY OF THE INVENTION

I provide a circuit which works for AC and DC applications, and provides a significantly increased life expectancy of the switch contacts it is used to protect. The invention provides isolation of the reed switch contract from the load it is controlling by establishing parallel electric current paths between inputs. Two such parallel paths provide for a symmetrical bi-directional steady state current flow within the protection circuit. Both parallel paths contain a controlled switching device which conducts current in the respective parallel path when the input polarity is proper. Having two such parallel paths in addition to the primary branch with the switch provides for a symmetrical isolation of the reed switch in alternating current circuitry. In addition when the switch protection invention is used in a DC circuit it can be installed between inputs without regard to the polarity of the circuit. The provision for the connection of the switch itself into the protection circuit is also polarity independent. The switch device can be installed in any manner between the switch connection terminals. The controlled switch devices in the parallel path may be semiconductor devices, such as transistors or SCRs, having their control signal derived from the voltage provided when the switch is closed. The switch is connected between two diodes having opposite polarities which upon switch closure automatically provides the signal to the proper controlled switching device or transistor. Further protection to the switch contacts is provided by a third parallel path having a voltage absorption device.

BRIEF DESCRIPTION OF THE DRAWINGS

The FIGURE is a schematic diagram of a presently preferred embodiment of the invention.

DESCRIPTION OF PREFERRED EMBODIMENTS

The FIGURE shows a circuit protection apparatus as used to protect a switch device specifically a reed switch device 10. Input 1 and input 2 as shown in the FIGURE would typically connected to the control circuit which is desired to have interface with the switched element 10. Typically the external control circuit, not shown, is designed for a functional contact opening or closure between input 1 and input 2 to sequence or control other circuits or equipment. One such application of this device would be in the control circuit of solenoid operated fluid valves, another includes sensing the position of a door. In such application Input 1 and Input 2 could be in series with a voltage source and a solenoid valve coil, such that closure or a low resistance circuit between input 1 and input 2 would cause the current in the solenoid coil to rise, thereby activating the solenoid valve. Other more complex applications of the switch protection circuit can be readily understood in typical control applications. In the embodiment shown in the FIGURE a primary branch is established between Input 1 and Input 2 by means of diode 13, reed switch 10, and diode 14. Terminals 11 and 12 connect reed switch 10 into the protection circuit, and it is to be understood that the reed switch may be located either remotely from the protection circuit or may be integrated with the packaging of the protection circuit.

Input diode 13 is shown to be a light emitting diode, and a presently preferred embodiment of the invention utilizes the light emitting diode 13 to indicate a mode of operation. Diodes other than LEDs could be used for diode 13 which do not give the visual mode indication of the LED 13. Similarly, diode 14 could also be of the light emitting type and provide additional visual mode indication or an indication of power to the circuit. Diodes 13 and 14 are both in the primary branch but in opposite polarities from each other.

In addition to the primary branch composed of diodes 13, 14, and switch 10, two parallel pathways are symmetrically established about the reed switch 10 which permit the circuit to work with AC and either polarity DC. In one parallel path diode 21 which is in the circuit having a current polarity corresponding to that of diode 13 provides current to transistor 22 which when conducting completes the current path via conductor 23 to input 2. The control of the transistor 22 which acts as a controlled switching device is established by a signal from terminal 12 which is located between switch 10 and diode 14.

A second parallel path is established symmetrically about switch 10 through transistor 32 and diode 31. Transistor 32, which acts as a controlled switch device, is placed in a conducting state when the respective voltage at point 11 is applied through resistor 34 to the base of transistor 32. In providing these two parallel paths in addition to the primary branch through the switch device 10, AC and bi-directional DC steady state current can be used with the circuit shown in FIG. 1.

In some presently preferred embodiments an additional or third parallel path containing a voltage absorbing semiconductor 41 is desirable to control the voltage spikes which may be present from time to time across the inputs of the circuit.

The semiconductor device 41 shown acts as back to back zener diodes to provide bi-directional voltage clipping and permits a parallel path around the switch 10 when either high voltage DC spikes are present across the input or when similar voltage surges occur across the input when the protection circuit is being operated in an AC mode. Other known devices which vary their resistance inversely with the voltage applied across them can also be used in place of the semiconductor device shown at reference 41. The voltage absorbing device 41 not only protects the switch element from overvoltage but in addition protects transistors 22 and 3 and the other semiconductor devices in the circuit from damage due to overvoltage.

Typical values for service components in presently preferred embodiments include the use of MJD-50 or TIP-50 transistors for 22 and 32. While the present preferred embodiment shown uses NPN transistors, it is understood that PNP types can equally be utilized with respective changes in the polarity of diodes 13, 14. These transistor units typically have a DC current gain of 30. This provides the protection control circuit which will generally permit 1/30th of the total current to be carried by the switch element 10 with the remaining current being carried by the respective parallel paths. In this way a 300 ma control circuit requires the reed switch to only function under loads of approximately 10 ma, and therefore the life expectancy of the switch unit can be greatly increased.

The circuit is generally symmetrical and can switch AC as well as DC currents. When Input 1 is more positive than Input 2, circuit elements 21, 22, 24 and 13 are primarily used in the circuit. The first parallel path is then used to conduct the majority current from Input 1 to Input 2. Diode 21 protects transistor 22 from reverse voltage breakdown and reduces the power dissipated in transistor 22 by approximately 20%. When Input 2 is more positive than Input 1, the majority of current flows through diode 31 and transistor 32. Diode 31 also protects transistor 32 from reverse voltage breakdown.

Components can be chosen so as to minimize the voltage drop across the protective circuit. By so doing, the power dissipated in the protective circuit can be maintained below 2 watts while handling switching currents in the order of ½ ampere. To further dissipate heat generated in the protective circuitry all of the elements can be encapsulated in a small solid packaging unit so as to improve heat dissipation. Such a unit then requires only four terminals, Input 1, Input 2, and terminals 11 and 12 for connection of a remote switch. In some applications it is understood that the switch 10 could be incorporated within the encapsulated unit providing for only a minimum number of terminal connections to place the protective circuit and its respective switch within the controlled circuit environment.

In other embodiments where only single polarity DC currents will be controlled, the circuit shown in the FIGURE can be reduced by the removal of transistor 32, resistor 34, diode 31 and diode 14. Such embodiment would then protect the switch 10 for DC circuits where Input 1 was always at a more positive voltage than Input 2.

Other embodiments of the invention will be apparent to those familiar with circuit control upon reviewing this invention.

I claim:

1. A switch protective apparatus for protecting a switch device in a circuit having a first and a second input wherein the switch device controls the AC and DC electrical connection between said first and second inputs comprising:

switch means for providing a mechanical switch device to be protected in a primary branch between said first and said second input;

first diode means intermediate and in series with said switch means and said first input for uni-directionally controlling the flow of current in said primary branch;

second diode means intermediate and in series with said switch means and said second input for uni-directionally controlling the current in said primary branch, and the polarity of said second diode means being opposite the polarity of said first diode means, thereby said primary branch comprises said first diode means connected directly from said first input directly to said switch means and said switch means connected directly to said second diode means and said second diode means connected directly to said second input;

a first parallel path between said first input and said second input and having a first controlled switching means for providing a low resistant current path between said first input and said second input when the polarity between said first and second input is the same as the polarity of said first diode means, and said switch means is in a closed position;

a second parallel path between said first input and said second input having a second controlled switching means for providing a current path between said first input and said second input when the polarity between said first and second inputs is the same as the polarity of said second diode means, said switch means is in a closed position; and substantially all steady state load current is conducted through said first parallel path and said second parallel path when said switch means is maintained in a closed position and said first parallel path and said second parallel path cease to conduct steady state current when said switch means is maintained in an open position.

2. The switch protective apparatus of claim 1 further including a third diode means in said first parallel path in series with said first controlled switching means, and having a polarity the same as said first diode means, and a fourth diode means in said second parallel path in series with said second controlled switching means, and having a polarity the same as said second diode means.

3. The switch protective apparatus of claim 2 wherein said first controlled switching means and said second controlled switching means responds to the voltage polarity across said inputs so as to alternatively provide a current path between said first parallel path and said second parallel path in response to polarity changes between said first and second inputs.

4. The switch protective apparatus of claim 2 wherein said first controlled switching means and said second controlled switching means are controlled by the voltage which is intermediate said first and second diode means when said switch means is in a closed position.

5. The switch protective apparatus of claim 1 wherein said first controlled switching mean is controlled by the voltage which is intermediate said switch means and said second diode means; and said second controlled switching means is controlled by the voltage intermediate said switch means and said first diode means.

6. The switch protective apparatus of claim 1 wherein said first controlled switching means and said second controlled switching means are semiconductor devices controlled by a respective control signal.

7. The switch protective apparatus of claim 6 wherein said first switching means is a transistor with said control signal being the voltage intermediate said switch means and said second diode; and said second controlled switching means is a transistor with said control signal being the voltage intermediate said switch means and said first diode means.

8. The switch protective apparatus of claim 1 further comprising a third parallel path between said first input and said second input, and said third parallel path having voltage suppression means.

9. The switch protective apparatus of claim 8 wherein said voltage suppression means is a semiconductor device.

10. The switch protective apparatus of claim 1 wherein said switch means is a reed switch.

11. The switch protective apparatus of claim 10 wherein said reed switch is in a circuit for the control of solenoid operated fluid valves.

12. The switch protective apparatus of claim 1 wherein at least one of said first and second diode means is a light emitting diode device.

13. The switch protective apparatus of claim 1 wherein said first diode means and said second diode means are light emitting diodes.

14. The switch protective apparatus of claim 1 further comprising wherein said first controlled switching means and said second controlled switching means are chosen such that the majority of the current between said first input and said second input passes through said first parallel path and said second parallel path rather than said primary branch.

15. The switch protective apparatus of claim 1 further including a third diode means in said first parallel path in series with said first controlled switching means, and said third diode means having a polarity the same as said first diode means;

a fourth diode means in said second parallel path in series with said second controlled switching means and said fourth diode means having a polarity as said second diode means;

said first switching means having a transistor with the switching signal being the voltage intermediate said switch means and said second diode; and said second controlled switching means being a transistor with the control signal from being the voltage intermediate said switch means and said first diode means.

16. The switch protective apparatus of claim 15 wherein at least one of said first and second diode means is a light emitting diode.

17. The switch protective apparatus of claim 10 wherein said reed switch is in a circuit for sensing the position of a door.

18. A switch protective apparatus for protecting a switch device in a circuit having a first and second input wherein the switch device controls the electrical connection between said first and second inputs comprising:

switch means for providing a mechanical switch device to be protected in a primary branch between said first and second input;

first diode means intermediate and in series with said switch means and said first input for uni-directionally controlling the flow of current in said primary branch, thereby said primary branch comprises said first diode means directly connected from said first input directly to said switch means and said switch means is directly connected to said second input;

a first parallel path between said first input and said second input and having a first controlled switching means for providing a low resistant current path between said first input and said second input when said switch means is in a closed position; and substantially all steady state load current is conducted through said first parallel path when said switch means is maintained in a closed position and said first parallel path ceases to conduct steady state load current when said switch means is maintained in an open position.

19. The switch protective apparatus of claim 18 further including a third diode means in said first parallel path in series with said first controlled switching means and having a polarity the same as said first diode means.

20. The switch protective apparatus of claim 18 wherein said first switching means is a transistor with a control signal being the voltage intermediate said switch means and said second input.

21. The switch protective apparatus of claim 19 having a third parallel path between said first and second inputs and said third parallel path having voltage suppression means.

22. The switch protective apparatus of claim 20 wherein said switch means is a reed switch.

* * * * *

UNITED STATES PATENT AND TRADEMARK OFFICE

CERTIFICATE OF CORRECTION

PATENT NO. : 5,151,840

DATED : September 29, 1992

INVENTOR(S) : ALLEN J. SIEFKEN

It is certified that error appears in the above-identified patent and that said Letters Patent is hereby corrected as shown below:

Column 3, line 56, change "3" to --32--.

Signed and Sealed this

Twelfth Day of October, 1993

*Attest:*

*Attesting Officer*

Bruce Lehman

BRUCE LEHMAN

*Commissioner of Patents and Trademarks*